United States Patent [19]

Maki et al.

[11] Patent Number: 4,632,630

[45] Date of Patent: Dec. 30, 1986

[54] FORKLIFT ATTACHMENT

[75] Inventors: Clyde M. Maki, Hartford, Wis.; Herbert Homann, Mississauga, Canada

[73] Assignee: Koehring Company, Brookfield, Wis.

[21] Appl. No.: 603,185

[22] Filed: Apr. 20, 1984

Related U.S. Application Data

[63] Continuation-in-part of Ser. No. 491,071, May 3, 1983, abandoned.

[51] Int. Cl.[4] ..... E02F 3/36

[52] U.S. Cl. ..... 414/700; 414/718; 414/671

[58] Field of Search ..... 414/718, 697, 700, 705, 414/667, 724, 706, 685, 732, 733, 671, 734, 708

[56] References Cited

U.S. PATENT DOCUMENTS

| | | | |
|---|---|---|---|
| 2,876,921 | 3/1959 | Salna | 414/700 |
| 3,133,653 | 5/1964 | Anderson | 414/700 |
| 3,312,361 | 4/1967 | Foster | 414/724 |
| 3,424,328 | 1/1969 | Gideonsen et al. | 414/705 |
| 4,381,166 | 4/1983 | Smart | 414/667 X |

FOREIGN PATENT DOCUMENTS

| | | | |
|---|---|---|---|
| 1590709 | 6/1981 | United Kingdom | 414/718 |

*Primary Examiner*—Terrance L. Siemens

*Attorney, Agent, or Firm*—Andrus, Sceales, Starke & Sawall

[57] ABSTRACT

A fork extension attachment for a boom-type forklift for use in loading and unloading a fragile cargo from commercial containers includes an extension portion pivotally connected to the outer end of the boom to allow pivotal movement of the extension in a vertical plane and a fork assembly having its inner end pivotally connected to the outer end of the extension portion to allow pivotal movement of the fork assembly in a vertical plane. The fork assembly includes at least two tines that are mounted for powered horizontal lateral movement relative to each other and relative to the longitudinal axis of the assembly. An electrical pendulum switch is provided for maintaining the fork assembly in a substantially horizontal position when desired.

1 Claim, 8 Drawing Figures

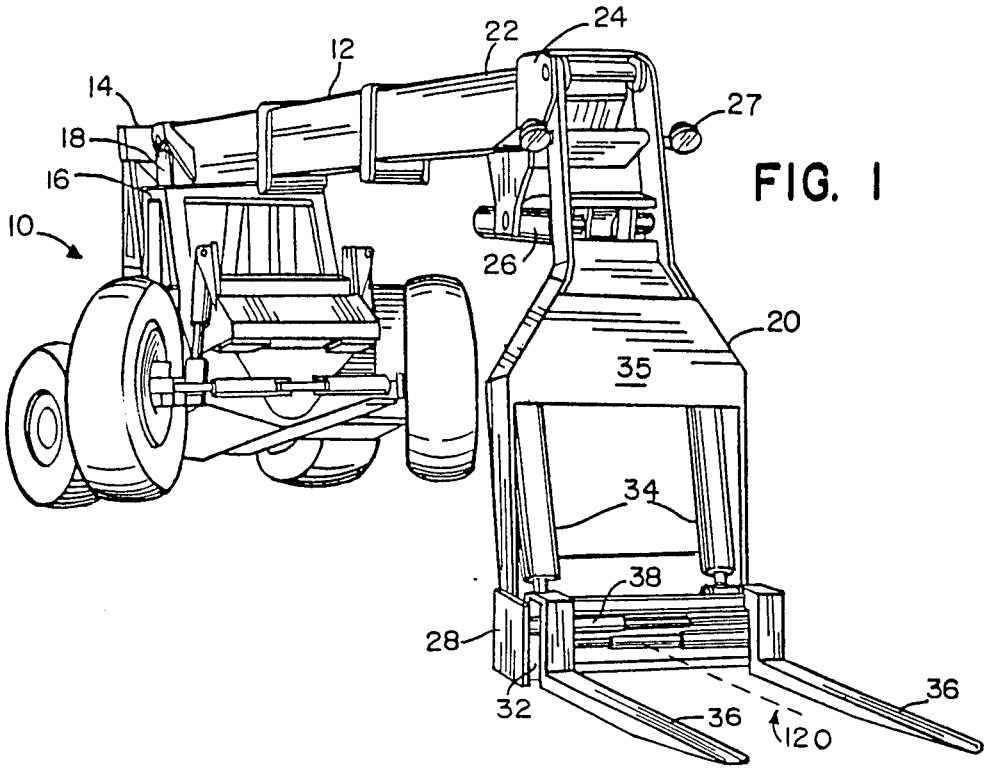
FIG. 1
FIG. 2
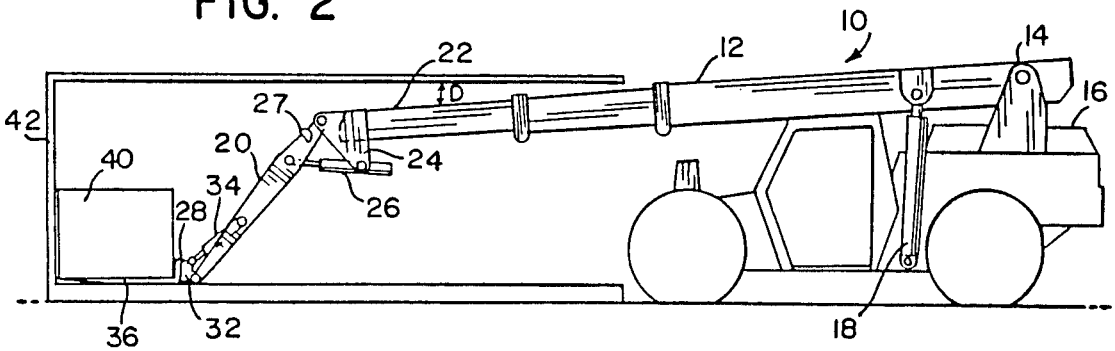
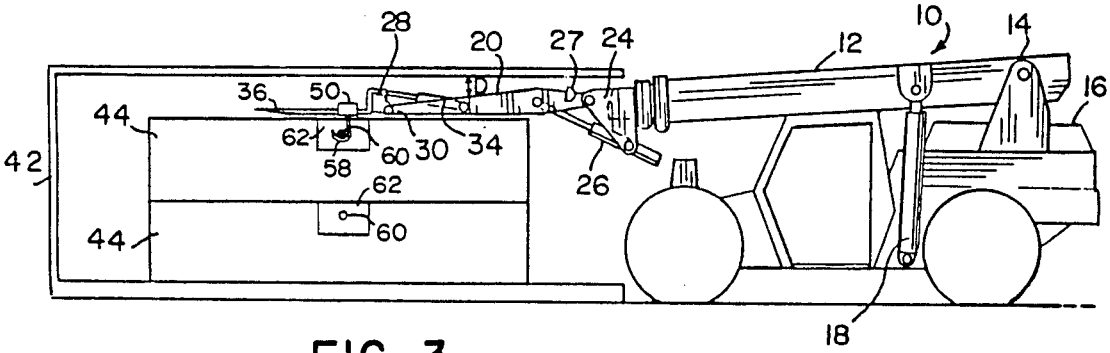
FIG. 3

FORKLIFT ATTACHMENT

CROSS REFERENCE TO RELATED APPLICATION

This application is a continuation-in-part to application Ser. No. 491,071 filed on May 3, 1983 now abandoned.

FIELD OF THE INVENTION

This invention relates to an attachment for a forklift and more particularly to a fork extension for a telescoping boom-type forklift for use in loading and unloading a fragile cargo from commercial containers of the type that ride piggy-back on trucks, ships and railroad cars.

This invention is particularly suited for retrieving ammunition pallets and/or missile pods from a twenty foot commercial container and is particularly useful when a customary loading dock is unavailable which is typically the case in a military setting. These containers typically have a verticle cross section of eight feet by eight feet, are twenty feet long and are open at one of their ends.

BACKGROUND OF THE INVENTION

Heretofore, boom-type forklifts have utilized a telescoping boom to which was attached a typical carriage with two forks. The fork attachment was operatively connected to the boom by means of hydraulic cylinders which could be slaved to the cylinders operating the boom. In this manner, the fork attachment could be maintained in a relatively horizontal position regardless of the pivotal up and down motion of the boom.

When the boom was extended in a substantially horizontal position, the forklift attachment would be substantially vertical in order to maintain the fork tines which are connected to the attachment at a 90° angle in a substantially horizontal position. Thus, the forklift attachment presented a very high profile when the boom was in a substantially horizontal position. This substantially limited the forklift's ability to load and/or unload pallets or containers densely packed in truck trailers or trailer mounted vans.

In view of the restrictions inherent in prior art forklifts, a variety of unloading methods have been used, all of which have drawbacks and disadvantages.

In using an ordinary forklift to unload pallets from a truck mounted container in the field, it was proposed to provide a ramp so that the forklift could enter the container and unload the cargo. This method has the obvious drawback of requiring a portable ramp and requiring that the forklift itself make several trips into and out of the container.

A "slip sheet" method of unloading pallets was also proposed in which a plastic or metal sheet was placed on the floor of the container and the pallets were placed on this sheet. When unloading the container the "slip sheet" would be pulled from the container onto a flatbed truck. Once on the flatbed truck ordinary forklifts would approach the cargo from the side of the truck and commence unloading the pallet. Besides the obvious problem of having the slip sheet tear, there was also the problem posed when the flatbed truck was not perfectly level or aligned with the container. These conditions would result in the slip sheet moving off to the side of the flatbed truck causing the pallets to fall.

In unloading missile pods from the container, it was customary to attach chains to the missile pods and drag them to the edge of the container until at least half of the missile pod extended out beyond the edge of the container. A first forklift would then engage the front of the missile pod to prevent it from falling while a second forklift would move in from the side of the missile pod and engage it at its approximate center of gravity so that it could be lifted from the container and transported to its ultimate location. This unloading method presented the hazard of precariously balancing a missile pod on the edge of a container and also necessitated the use of three pieces of machinery; one to pull the pods from the container, one to support the emerging end of the pod and one to engage the center of the pod and remove it from the container.

It is an object of the present invention to provide a forklift attachment that is specifically adapted for "unloading" fragile cargo such as ammunition pallets or missile pods from truck trailers or trailer mounted vans or containers.

It is also an object of the present invention to provide a forklift attachment having horizontally adjustable tines on the fork assembly.

It is yet another object of the present invention to provide leveling means for the fork assembly that is independent of the operation of the cylinders controlling the position of the boom.

SUMMARY OF THE INVENTION

A forklift attachment for a boom-type forklift for use in loading and unloading a fragile cargo from commercial containers of a predetermined length includes an extension portion that is pivotally connected to the outer end of the boom to allow pivotal movement of the extension in a vertical plane.

In accordance with another aspect of the invention, a fork assembly is provided having its inner end pivotally connected to the outer end of the extension portion to allow pivotal movement of the fork portion in a vertical plane.

In accordance with another aspect of the invention, the pivotal connection between the boom and the extension portion may be interrelated with the pivotal connection between the extension portion and the fork portion so as to permit the forklift attachment to handle cargo within a closely confined area.

In accordance with yet another aspect of the invention, the fork assembly is provided with at least two tines that are mounted for horizontal movement relative to each other on the fork assembly. The tine positions are adjustable simultaneously as well as independently. Each tine may be adjusted to either side of a center position of the fork assembly.

In accordance with still another aspect of the invention, the fork assembly is provided with an electrical pendulum switch that monitors the position of the fork assembly and releasably maintains the fork assembly in a horizontal position.

In accordance with yet another aspect of the invention, the forklift is provided with a tine accessory that is particularly adapted to engage the lift rod located at the center of a missile pod.

The present invention thus provides a forklift attachment and accessories that are ideally suited to the loading and unloading of truck trailers or trailer mounted vans or containers in that the forklift attachment may be positioned in a substantially horizontal plane while the boom is maintained in a similar plane. The invention provides a very low profile for the forklift attachment and allows the boom and forklift attachment to be inserted into a closely packed trailer or the containerized shipping. Maintaining a low profile is important when it is understood that containers of a predetermined size are utilized in trailers and containerized shipping. The tines of the forklift attachment must be able to engage and lift cargo from deep recesses and/or with very small height clearance.

The horizontal movement of the tines on the fork facilitates the precise positioning needed for engaging the lift rod on a missile pod and for sliding beneath a cargo pallet. The horizontal movement of the tines also permits the cargo to be shifted in a horizontal plane prior to removing it from the container so as to free it from the container wall or adjacent cargo.

BRIEF DESCRIPTION OF THE DRAWINGS

The drawings illustrate the best mode presently contemplated of carrying out the invention.

In the drawings:

FIG. 1 is a prospective view of a boom-type forklift constructed according to the invention;

FIG. 2 is a side elevational schematic of the forklift of FIG. 1 shown unloading a pallet from a container placed on the ground;

FIG. 3 is a side elevational schematic of the forklift shown in a raised position utilizing a tine accessory to unload pods from a container placed on the ground;

DESCRIPTION OF THE PREFERRED EMBODIMENT

Figure 4:
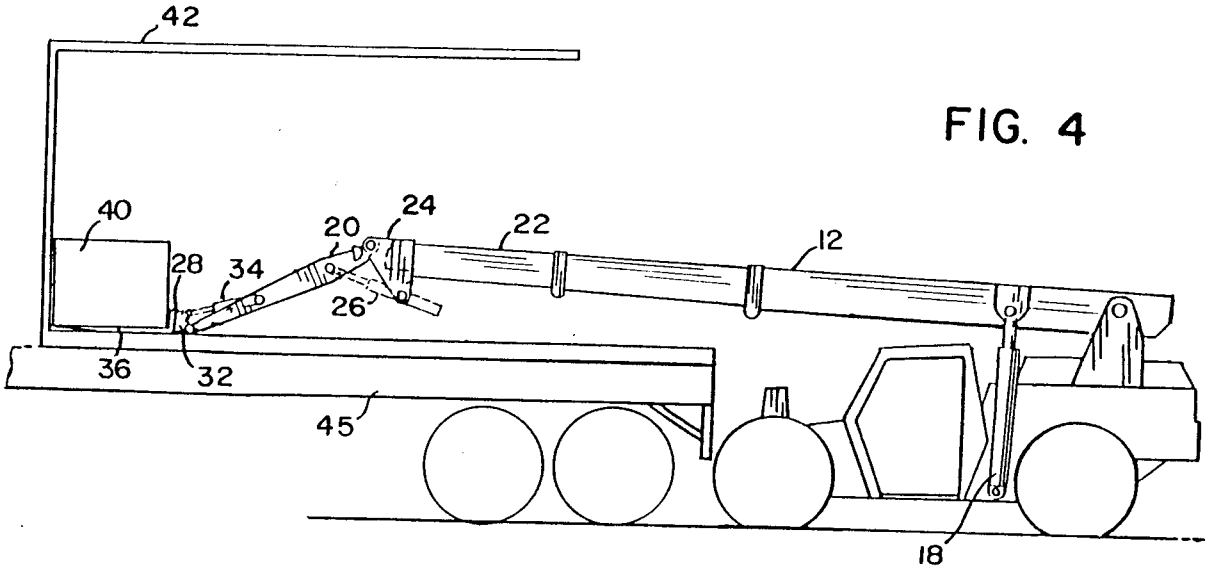
FIG. 4 is a side elevational schematic of the forklift shown unloading a pallet from a container located on an elevated truck bed.
Figure 5:
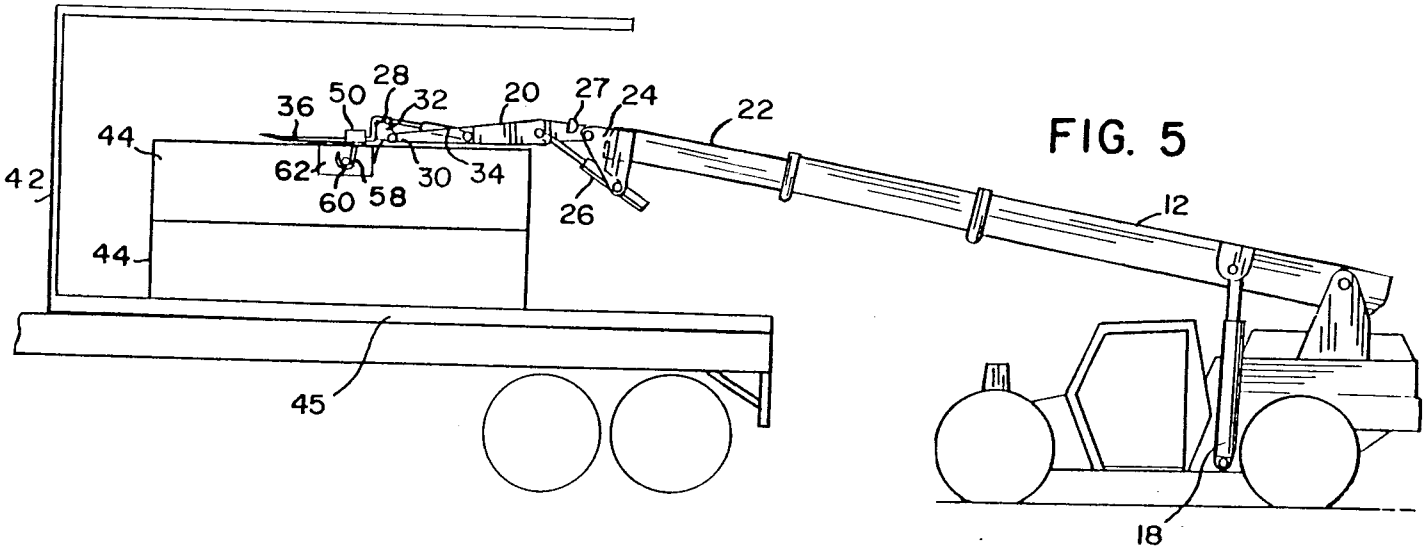
FIG. 5 is a side elevational of the forklift of FIG. 3 shown unloading pods from a container located on an elevated truck bed.
Figure 6:
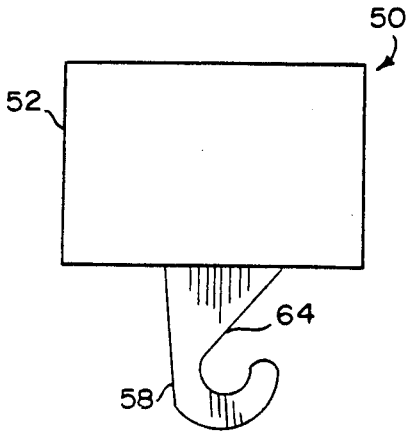
FIG. 6 is a side elevational view of the double hooked tine accessory shown in use in FIG. 3.
Figure 7:
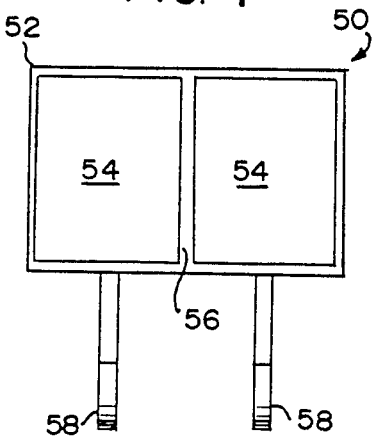
FIG. 7 is a front elevational view of the tine accessory of FIG. 4.

A telescoping boom-type forklift 10 includes a telescoping boom 12 having its inner end 14 pivotally mounted to a rough terrain vehicle having vehicular body 16. Vehicular body 16 is of the type described in U.S. Pat. No. 3,937,339 (the disclosure of which patent is incorporated herein by reference) in that it is provided with a leveling device that allows the vehicle body to be tilted relative to the wheeld frame. This makes forklift 10 particularly adapted to use in an uneven terrain. Forklifts such as this are typically about twenty-four feet long in the carry position, ninety-six inches wide and eight feet high (boom horizontal).

As is customary with machinery of this type, hydraulic cylinders 18 are utilized to position boom 12 at a variety of angles with respect to the horizontal.

An extension portion 20 is pivotally mounted to the outer end 22 of boom 12 by means of mounting plate 24 and hydraulic cylinders 26, with the pivot axis of the connection of the cylinder 26 to the plate 24 located well below the pivot axis for the extension 20 as shown, it is feasible to swing the extension to a level such that it is generally aligned with or even beyond the longitudinal axis of the boom 12.

The inner end of extension 20 is provided with a pair of lights 27 fixedly mounted to the sides of extension 20 so that lights 27 will follow the movement of extension 20.

As shown in FIG. 2, a fork assembly 28 is pivotally connected to the outer end 30 of extension 20 by means of connecting plate 32 and hydraulic cylinders 34. Thus, fork assembly 28 may be pivoted in a vertical plane and this pivotal motion is completely independent of the pivotal motion of boom 12 and/or the pivotal movement of extension portion 20.

As best seen in FIG. 1 fork assembly 28 includes a pair of telescoping hydraulic cylinders 38 that are mounted for horizontal movement of fork tines 36.

The horizontal movement of tines 36 is power driven and more specifically hydraulically powered and each of tines 36 may be moved independently of the other. Further, each of the tines may be moved past a centerline 120 of the extension portion 20 so as to position both tines 36 to one side or the other of the centerline 120.

As seen in each of the figures, fork assembly 28 is normally kept in a horizontal plane. In the past, this has been accomplished by the operator through the exercise of good judgment in manipulating the controls of the hydraulic cylinders and by automatic systems that the operator could activate if desired. For example, a level condition of the load during high lift operations could be maintained by having fork cylinders 34 slave to boom cylinders 18 so that pivotal motion of boom 12 resulted in a corresponding motion of fork assembly 28 and the fork assembly was kept in a substantially horizontal position.

However, due to the number of posssible positions of extension portion 20, the maintaining of a horizontal position for fork assembly 28 cannot be accomplished by making fork cylinders 34 slave to boom cylinders 18. For example, FIG. 1 shows the extension portion 20 in a position which is substantially vertically positioned, i.e., the hydraulic cylinder 26 is substantially fully retracted and the tines 36 are substantially horizontal to the horizon and the boom 12 is fully retracted. FIG. 2 discloses a fully extended boom 12 with the extension portion 20 partially extended, by cylinder 26, so as to enable the tines 36 to engage and support a pallet 40. The amount of clearance between the extended boom 12 and the top wall of the container 42 is indicated by a distance D. Accordingly, the cylinder 18 could not be extended to any substantial degree to raise the boom 12 and thereby lift the pallet 40. Therefore, any lifting of the pallet 40 is necessarily accomplished by extending the hydraulic cylinder 26 so as to pivot the extension portion 20 and lift pallet 40. As explained below, the tines 36 are required to remain within a small range of movement to the horizontal.

Figure 8:
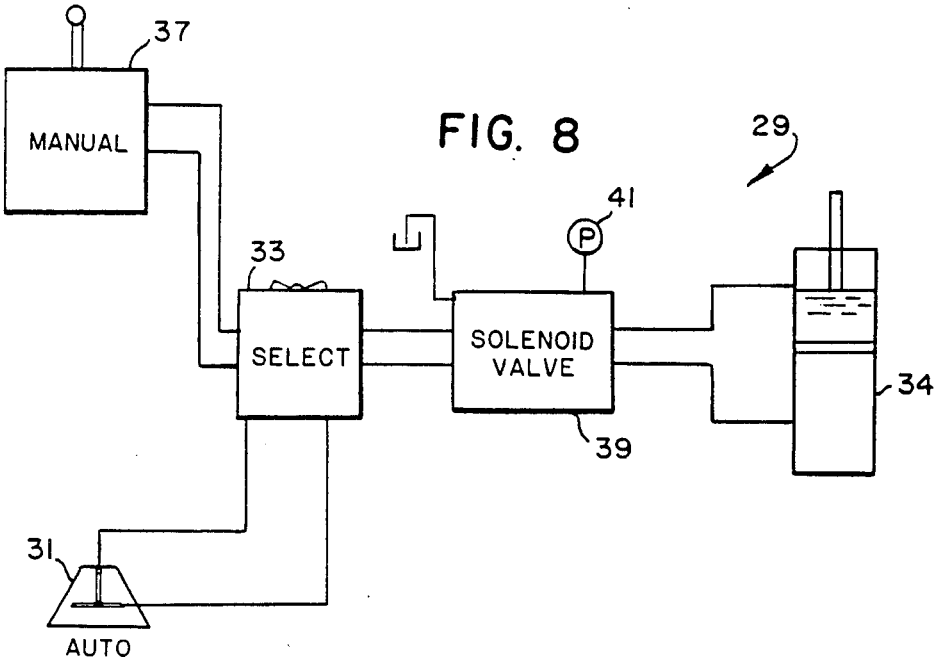
FIG. 8 is a schematic diagram of the leveling circuit utilized to maintain the tines in a substantially horizontal position.

Fork assembly 28 has been provided with a leveling circuit 29 schematically shown in FIG. 8. Leveling circuit 29 includes pendulum switch 31 located on assembly 28 directly behind cylinders 38. While other forms of automatic leveling may be used, a pendulum switch such as that sold by P-Q Controls, Inc. under Model No. 410 has been found to be appropriate for the particular needs of this application. Pendulum switch 31 is mounted at an angle so that a 2° upward tilt of tines 36 will be detected by switch 31 as horizontal. The pendulum of switch 31 swings in a path substantially parallel to the longitudinal axes of tines 36 and is adjusted to generate a signal upon detecting a predetermined angle in the range of 1½° to 3°. The output of switch 31 is connected to a select switch 33 which allows switch 31 to be removed from the circuit so that manual control 37 may be utilized. The pendulum switch is operatively connected via switch 33 to a proportional solenoid control valve 39 located behind plate 35 on extension portion 20. The control valve 39 controls the fluid that is provided to hydraulic cylinders 34. Upon sensing a non-horizontal condition for fork assembly 28, the pendulum switch 31 provides a signal to the solenoid control valve 39 and hydraulic fluid is provided from pump 41 to cylinders 34 in order to maintain fork assembly 28 in a relatively horizontal position.

FIG. 2 illustrates the use of the forklift attachment in unloading a pallet 40 from a forward position in a container 42. While FIG. 2 and FIG. 3 show the cargo container on the ground or on the same level as forklift 10, it should be appreciated that forklift 10 is particularly well suited to unloading containers that are elevated as when carried by a truck trailer. Here boom 12 is extended to substantially its maximum length and extension 20 is positioned at the proper angle in order to provide further fork extension and also to position fork assembly 28 beneath the pallet. The horizontal movement of tines 36 is particularly helpful in this operation in that various cargo pallets 40 may have different tine accepting areas and forklift 10 may not always be perfectly aligned with pallet 40. Since both of these situations may arise in a single cargo handling operation, the tines 36 are provided with a wide range of horizontal movement including movement from their extreme outboard position shown in FIG. 1 to a position beyond the centerline 120 so as to enable both tines 36 to be positioned on one side of the centerline 120. Also, it is not unusual during transportation for pallet 40 to have shifted and become engaged with the wall of container 42 or with an adjacent pallet. A slight horizontal movement of tines 36 will disengage pallet 40 and the pallet may then be removed by either preferably retracting telescoping boom 12 or by backing forklift vehicle 10 away from container 42.

FIG. 3 illustrates the use of forklift 10 when removing a cargo filled container or pod 44 such as a missile pod from a container 42. In this operation, forklift 10 utilizes a double hooked tine accessory 50. Accessory 50 consists of a rectangular framework 52 divided into a pair of tine receiving chambers 54 by center plate 56. A pair of lifting bar engaging hooks 58 are attached to framework 52 and extend downwardly with one hook 58 centered and below each of chambers 54. The entire height of accessory 50 is approximately nine inches so as not to add to the low profile because it is in a situation such as this that the low profile of extension portion 20 and fork assembly 28 are extremely advantageous. Each of pods 44 is provided with a recessed lifting bar 60 located at the approximate center of gravity of pod 44 in an opening 62. In that lifting bar 60 does not run the entire width of pod 44 the horizontal movement of tines 36 and the resulting horizontal movement of accessory 50 once again is very important. As is seen in FIG. 3, tines 36 are horizontally positioned and inserted through chambers 54. Accessory 50 may be manually engaged with lifting bar 60 and then tines 36 inserted into chambers 54 or accessory 50 may be positioned for engagement with lifting bar 60 while it is on tines 36. Extension portion 20 is moved to a substantially horizontal position and fork assembly 28 is maintained in a substantially horizontal position. Hooks 50 are positioned above opening 62 behind lifting bar 60. Hooks 58 are then lowered into opening 62 and moved forward until the back portion 64 of hooks 58 engages lifting bar 60. Pod 44 may then be lifted slightly and, if necessary, be moved horizontally, as discussed above in order to disengage it from the container wall or adjacent pods. Pod 44 may then be removed from container 42 by preferably retracting boom 12 if in an extended position or by backing forklift 10 away from container 42.

While FIGS. 2 and 3 illustrate only two applications of the present invention, extension 20 and fork assembly 28 may be positioned in an endless number of combinations and thus the potential uses for a forklift extension of this type are virtually endless.

Various modes for carrying out the invention are contemplated as being within the scope of the following claims particularly pointing out and distinctly claiming the subject matter which is regarded as the invention.

We claim:

1. A fork extension attachment for a boom-type forklift wherein said boom has its inner end pivotally connected to a vehicular body, said attachment comprising an extension portion having its inner end pivotally connected to the outer end of said boom to allow pivotal movement of said extension in a vertical plane and a fork assembly having at least two horizontally spaced tines, the assembly having its inner end pivotally connected adjacent the outer end of said extension portion to allow pivotal movement of said fork assembly in a vertical plane, said fork assembly including at least two tines mounted on a carriage for horizontal movement on said carriage relative to each other, power means for moving said tines independently of each other or in unison, with each of said tines movable from an extreme outboard position to a position beyond the centerline of said carriage, leveling means for releasably maintaining said fork assembly in a substantially horizontal position, said leveling means comprising an electrical pendulum switch operatively connected to means for providing hydraulic fluid to hydraulic cylinder means used to position said fork assembly about said pivot point, and the pendulum of said pendulum switch swings in a path substantially parallel to the longitudinal axes of said tines and said pendulum switch is mounted in such a manner that an upward tilt of approximately two degrees for said tines is detected as being substantially horizontal by said pendulum switch.

* * * * *